United States Patent [19]

Freeman et al.

[11] 4,264,993

[45] May 5, 1981

[54] METHOD FOR SPACE DYEING YARN

[75] Inventors: Danny M. Freeman, Dalton; Milton M. Knight, Jr., Calhoun; Clarence M. Payton, Adairsville; Robert S. Simpson; Howard B. Smith, Jr., both of Calhoun, all of Ga.

[73] Assignee: Calhoun Yarn Services, Inc., Calhoun, Ga.

[21] Appl. No.: 922,539

[22] Filed: Jul. 7, 1978

[51] Int. Cl.[3] ..... D06B 5/20

[52] U.S. Cl. ..... 8/149; 8/149.1; 8/149.3; 8/155.2; 68/5 C; 68/201

[58] Field of Search ..... 8/14, 15, 149, 149.1, 8/149.2, 149.3, 150, 154, 155.2; 68/5 C, 6, 201, 205 R, 206, 187, 189, 194, 196

[56] References Cited

U.S. PATENT DOCUMENTS

| | | | |
|---|---|---|---|
| 1,060,277 | 4/1913 | Murray | 68/189 |
| 1,922,511 | 8/1933 | Van Ness | 68/201 |
| 1,948,568 | 2/1934 | Faber et al. | 8/149.1 X |
| 3,547,575 | 12/1970 | Theodores | 8/149.1 |
| 4,052,155 | 10/1977 | Rosenthal et al. | 8/149X |
| 4,086,688 | 5/1978 | Dombrowski | 8/149 X |
| 4,183,233 | 1/1980 | Brown | 68/196 X |

*Primary Examiner*—Philip R. Coe

*Attorney, Agent, or Firm*—Bell, Seltzer, Park & Gibson

[57] ABSTRACT

A method and apparatus for the space dyeing of yarn while the yarn is in the form of a loosely gathered package, such as a conventional yarn skein, and which includes injecting an atomized spray of dye and air at a plurality of spaced apart locations in the package, and such that the dye contacts only a portion of the yarn. The resulting yarn is characterized by essentially random and relatively short colorband lengths, which avoid the formation of unsightly streaks or "chevrons" on the face of a fabric formed from the yarn.

9 Claims, 6 Drawing Figures

METHOD FOR SPACE DYEING YARN

The present invention relates to a method for randomly dyeing yarn in skein form, and which is characterized by the ability to produce a nonrepeating, "short space" color pattern on the yarn and such that the formation of visible streaks or "chevrons" on the face of the finished fabric is avoided.

A common problem associated with space dyed yarn is the fact that the yarn often has a regularly repeating color pattern along its length which can, in certain finished fabric constructions, produce visible streaks or "chevrons" on the face of the fabric. As one specific example, this problem is prevelant where the yarn is fabricated into a tufted carpet having a relatively short, level pile.

It is generally recognized that the formation of streaks or "chevrons" can be alleviated by applying totally random, "short space" colorband lengths to the yarn, and several processes have heretofore been proposed and commercialized which seek to achieve a pattern of this type. One such process is known as the "knit de knit" process, wherein the yarn is knit into a prefabric which is subjected to a printing operation, and then unraveled to produce a space dyed yarn. As will be apparent, however, this process is relatively slow, and in addition, the required manipulation of the yarn tends to remove a considerable portion of the bulk. In another known process, a warp of yarns is fed through a series of dye applicator rollers which apply the color in a desired pattern. Here again however, the tension which is necessarily applied to the yarn during the printing operation tends to reduce its bulk, and a totally random pattern is difficult to achieve by reason of the structural limitations of the applicator rollers.

It has also been suggested to dye wound packages or cones of yarn by inserting one or more needles into the package and injecting a dye through the needles so as to be applied to spaced areas in the package, note for example the patent to Van Ness, U.S. Pat. No. 1,922,511. This procedure is not totally satisfactory however, since the needles tend to break the yarns in the package, and uniform dye application is difficult to achieve since the inner portion of the package has a smaller diameter than the outer portion.

It is accordingly an object of the present invention to provide a method for efficiently and economically producing space dyed yarn, wherein the color pattern is essentially random and of relatively short colorband lengths.

It is a more particular object of the present invention to provide a method for space dyeing yarn in a multicolored pattern, and which is characterized by the ability to utilize the resulting yarn in forming the pile of a tufted carpet or the like, and without unsightly streaks or "chevrons" being visible on the face.

These and other objects and advantages of the present invention are achieved in the embodiment illustrated herein by a method for space dyeing yarn which includes provision for injecting an atomized spray of dye at a plurality of locations in a loosely gathered package of yarn and such that the dye contacts a portion only of the yarn. In the preferred embodiment, the apparatus for carrying out the method comprises an open container adapted to receive a loosely gathered package of yarn therein, a plurality of spaced apart nozzles operatively associated with the container and adapted to penetrate the package at spaced apart locations when the package is positioned in the container, and means for supplying dye and air under substantially equal pressures to each of the nozzles and so that a pressurized mixture of the dye and air is emitted from the nozzles. Where a multi-color pattern is desired, the apparatus further includes a plurality of separate dye supply tanks, and means for operatively connecting each of the supply tanks with respective ones of the nozzles. Some of the objects having been stated, other objects will appear as the description proceeds, when taken in connection with the accompanying drawings in which FIG. 1 is a schematic flow diagram illustrating the basic steps of a process embodying the present invention;

Figure 1:
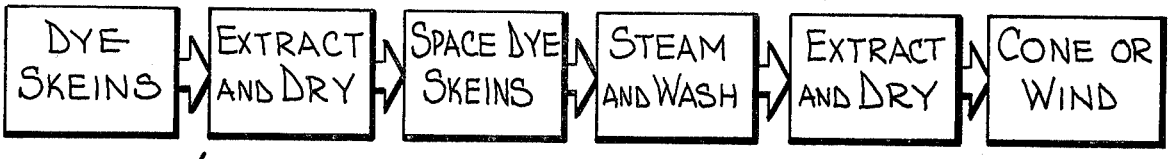
Figure 2:
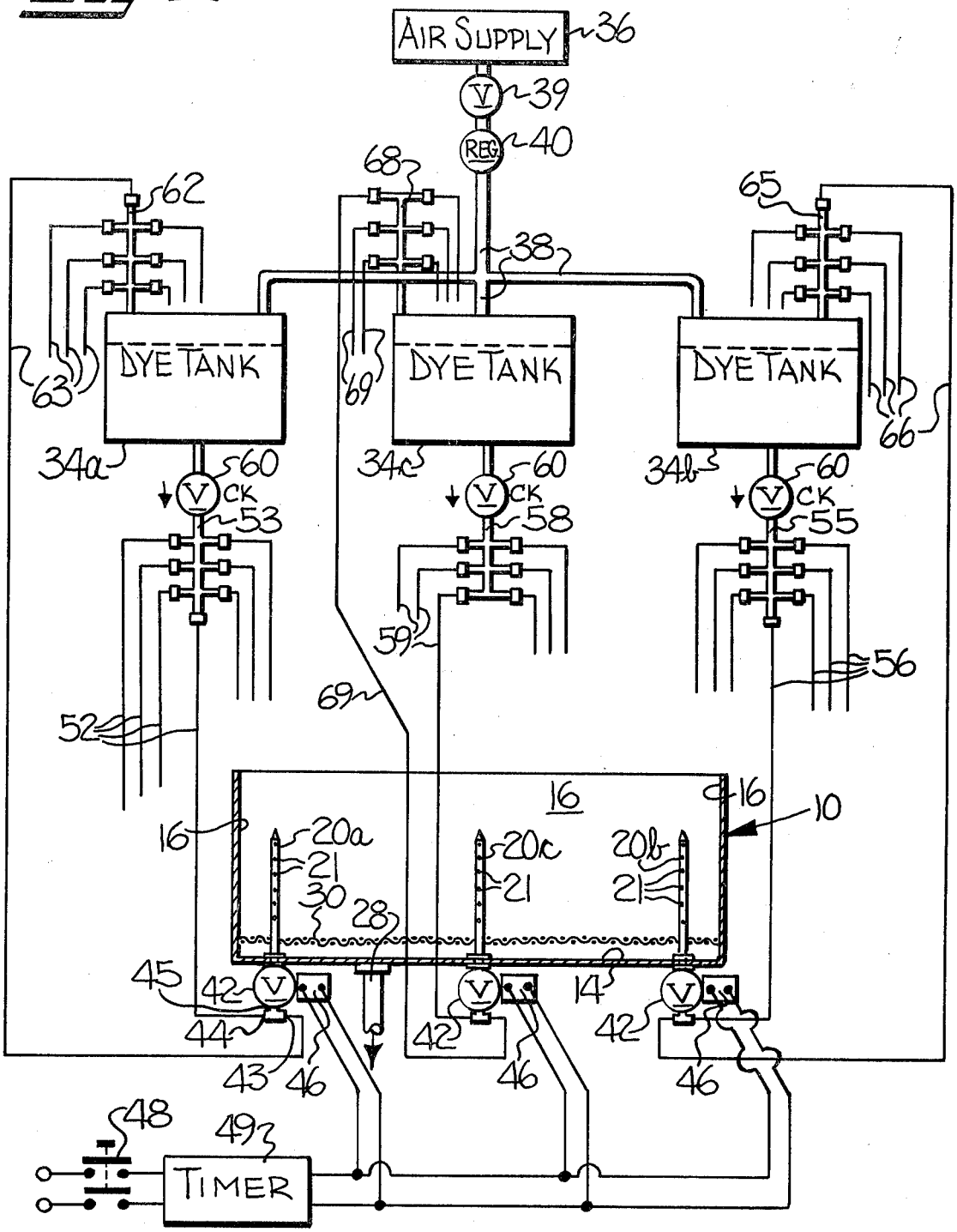
FIG. 2 is a schematic representation of an apparatus which embodies the features of the present invention.

Referring more particularly to the drawings, an apparatus embodying the features of the present invention is illustrated somewhat schematically in FIG. 2. As shown, the apparatus comprises a rectangular open container 10 which is supported by a framework 12 so as to be positioned approximately waist high to facilitate use by an operator in the manner hereinafter further described. The container 10 comprises a flat bottom wall 14, four peripheral side walls 16, and a plurality of spaced apart nozzles 20 affixed to the bottom wall and extending perpendicularly therefrom. The nozzles 20 are generally uniformly spaced over the full area of the bottom wall in plan, note FIG. 5.

Figure 6:
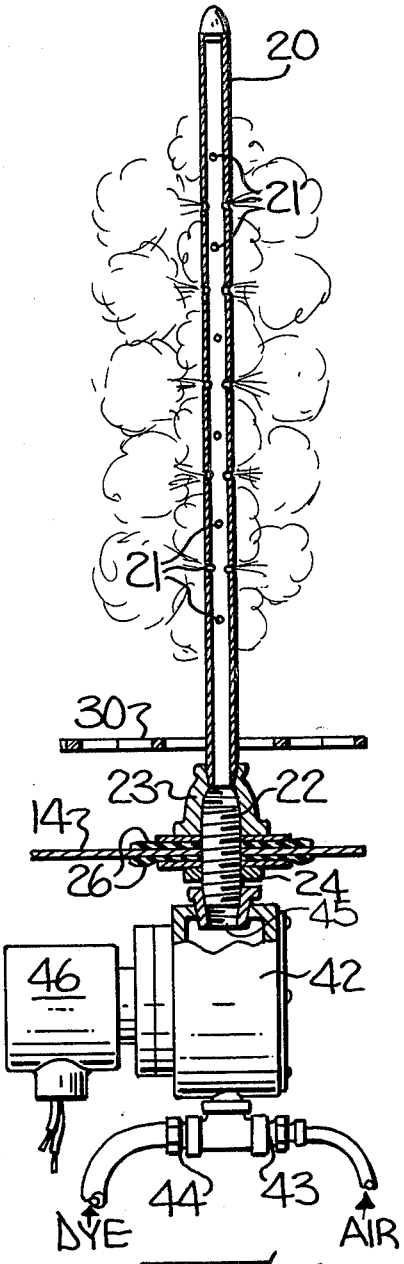
FIG. 6 is a sectional view of one of the injection nozzles of the apparatus shown in FIG. 4, and taken substantially along the line 6—6 thereof.

As best seen in FIG. 6, each nozzle 20 comprises an elongate tubular member having a plurality of apertures 21 along its length, and the lower end is sealably mounted to the bottom wall 14 by an arrangement which includes a tubular threaded member 22 extending through the bottom wall, a flange 23 fixed to the lower end of the nozzle and threadedly received on the member 22, and a nut 24 received on the member 22 below the bottom wall. Also, suitable sealing washers 26 may be interposed between the flange 23 and bottom wall 14, and between the nut 24 and bottom wall.

The container 10 also includes a drain 28 positioned in the bottom wall 14, and an open mesh screen 30 is provided which is adapted to be positioned within the container and in spaced relation above the bottom wall 14, with the nozzles 20 extending upwardly therethrough. Preferably, the screen 30 is sized to conformingly overlie the bottom wall 14, and is supported by integral, downwardly directed legs (not shown). By this arrangement, the screen 30 may be lifted upwardly and removed from the container to facilitate the cleaning or repair of the various components.

Figure 5:
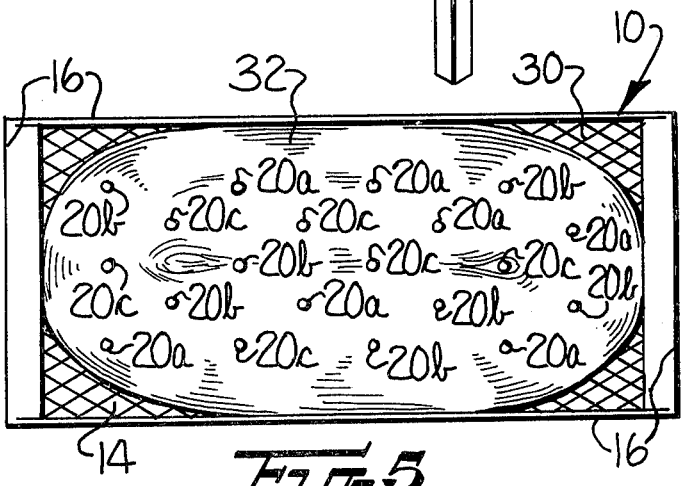
FIG. 5 is a plan view of the apparatus shown in FIG. 4 and further illustrating a skein of yarn received therein.

The container 10 is typically sized so as to be adapted to receive at least one standard, six pound skein of yarn 32 in the manner shown in FIG. 5. As a specific example, the side walls 16 of the container may measure about 36 by 16 inches, and they are about ten inches in height. The nozzles 20 extend about nine inches from the bottom wall 14, and the screen 30 is positioned about two inches from the bottom wall.

The illustrated embodiment of the apparatus further includes three dye supply tanks 34*a*, 34*b*, and 34*c*, which are preferably in the form of closed, pressurizable drums. A pressurized air supply 36 is also provided, and which includes an air line 38 to each of the three tanks. A shut off valve 39 and a pressure regulator 40 is also provided, whereby a like, predetermined pressure may be maintained in each of the tanks.

Means are also provided for supplying dye from each of the dye supply tanks to respective ones of the nozzles, and for supplying air from the supply to each of the nozzles. This means for supplying the dye and air comprises a valve 42 associated with each nozzle 20 and positioned below the bottom wall 14. The valves 42 are generally conventional, and each comprises a pair of inlets 43, 44, and an outlet 45 connected to the lower end of its associated nozzle via the tubular threaded member 22, note FIG. 6. A solenoid 46 is also provided for controlling the operation of each valve, with the solenoids in turn being controlled by a switch 48 and timer 49, note FIG. 2.

As best seen in FIG. 2, each tank 34*a*, 34*b*, and 34*c* is connected to a number of the nozzles 20 via a manifold and individual lines, which are in turn connected to the inlets 44 of the associated valves. More particularly, the tank 34*a* is connected to seven of the nozzles (designated as 20*a* in FIGS. 2 and 5) and seven lines 52 emanate from the manifold 53. The tank 34*b* is similarly connected to seven nozzles 20*b* via the manifold 55 and seven lines 56, and the tank 34*c* is similarly connected to six nozzles 20*c* via the manifold 58 and six lines 59. A one way check valve 60 is interposed between each tank and its associated manifold to prevent reverse flow of the dye.

Means are also provided for interconnecting the pressurized air supply 36 to the other inlet 43 of each valve. As illustrated, this air supply means comprises a manifold 62 associated with the tank 34*a* and seven air lines 63 leading therefrom to the valves of the associated nozzles 20*a*. Similarly, there is provided a manifold 65 associated with the tank 34*b* and seven lines 66 leading therefrom to the associated nozzles 20*b* and a manifold 68 associated with the tank 34*c* and six lines 69 leading therefrom to the associated nozzles 20*c*.

From the above arrangement, it will be apparent that the dye and air will be supplied to each nozzle under substantially equal pressures, which are controlled by a single regulator 40. Such equalization of pressure has been found to effectively assure that both the dye and air will pass through the valve 42 and into the nozzle 20 during the dyeing operation. Also, the use of individual valve 42 positioned immediately adjacent each nozzle 20 has been found to result in substantially equal distribution of dye among the nozzles, and the close proximity of the valve 42 to the nozzle avoids any buildup of liquid dye between the valve and nozzle which could result in an initial, non-atomized squirt of dye being emitted from the nozzle during the injection operation.

A representative method of dyeing skeins of textile yarn employing the above apparatus and in accordance with the present invention will now be described. In this regard, it will be noted that the apparatus and method of the present invention are particularly suited for space dyeing nylon and polyester yarn useful in fabricating tufted carpet, although the invention is also suitable for processing wool, cotton, acrylic, and other polymeric yarns.

The yarn is initially formed into skeins 32 in a conventional manner, and preferably, the winding operation includes a number of traverses (which is a known technique) to thereby form a non-regularly wound skein.

The skeins 32 are usually initially dyed a base color, utilizing a conventional vat dyeing operation or the like. The skeins are then placed in a centrifugal extractor, and then a dryer, to remove most of the moisture. Individual skeins are then positioned in the container as shown in FIG. 5, with the skein being pressed down by hand so that the skein rests on the screen 30 and the nozzles 20 penetrate substantially entirely through the skein. The operator then closes the switch 48, causing all of the valves 42 to concurrently open for a predetermined time period which is controlled by the timer 49.

The opening of the valves 42 results in the pressurized dye and air being forced into the nozzles 20, and to be emitted through the apertures 21 in the form of an atomized spray or fog. Typically, the dye and air is maintained under a pressure of between about 40 to 60 psi, and the valve 42 remains open for about one to two seconds. This results in the atomized dye contacting a portion only of the yarn, and it has been found that the skein absorbs substantially all of the dye with little if any trickling or running of liquid dye through the skein. In the event any dye should reach the bottom wall 14 of the container, it may be subsequently removed by flushing through the drain 28. Also, the screen 30 prevents the skein from contacting any puddles of dye which may form on the bottom wall.

Figure 3:
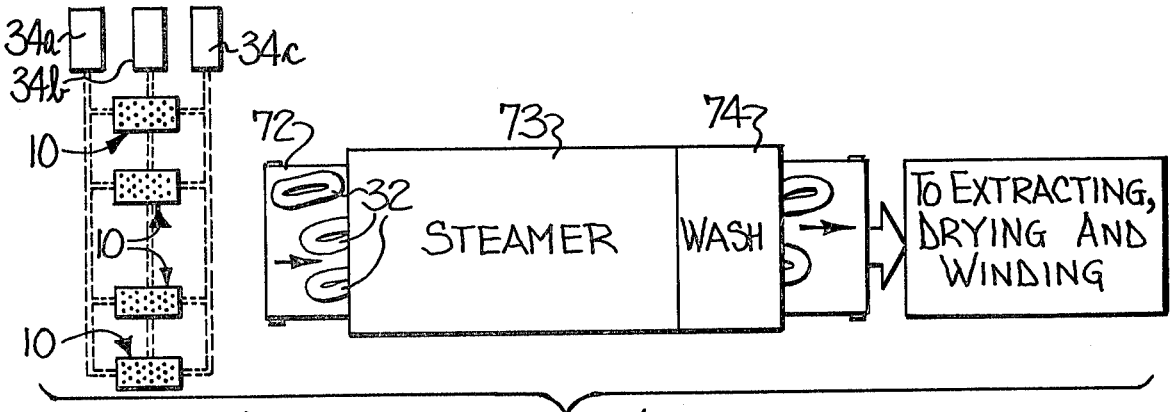
FIG. 3 is a schematic plan view of the apparatus of the present invention, together with the equipment for the subsequent processing of the yarn.
Figure 4:
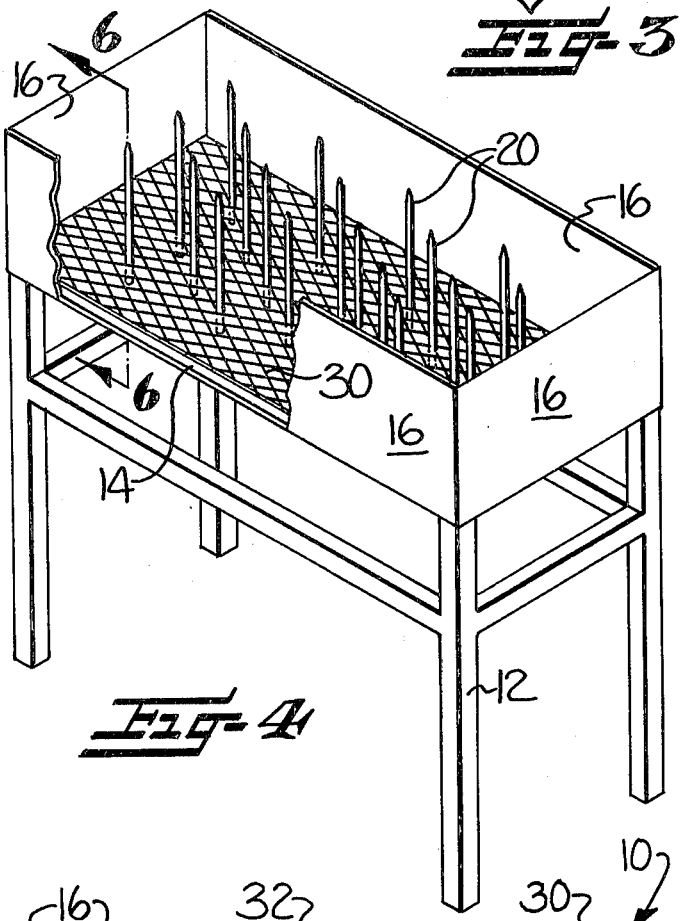
FIG. 4 is a perspective view of a container for receiving and dyeing skeins of yarn in accordance with the present invention.

The skein is then removed from the container 10 and laid on a moving belt 72 which passes through a steamer 73 to fix the dye, and then through wash heads 74 to wash off any excess of the dye. The skeins are removed at the downstream end of the belt 72, and placed in an extractor and dryer to remove most of the moisture. Finally, the skeins are wound into cones in the conventional manner. In order to increase production, a number of containers 10 may be positioned adjacent the steamer and washer in the manner illustrated schematically in FIG. 3.

As will be apparent, the present invention is susceptible of a number of variations which can be employed to vary the pattern of applied dye. For example, the nozzles 20 may be unevenly positioned in the container 10, and the length of the nozzles may be varied. Also, the dye tanks may be connected to different numbers of the nozzles. The present invention is also susceptible to resist dyeing techniques wherein an undyed skein is treated with a resist agent or dye in the container, and then overdyed, thereby providing a variation in shade in the overdye. This resist dyeing technique facilitates the dyeing of a yarn so as to have a dark background with lightly colored spaced areas.

In the drawings and specification, there has been set forth a preferred embodiment of the invention, and although specific terms are employed, they are used in a generic and descriptive sense only and not for purposes of limitation.

That which is claimed is:

1. A method for space dyeing yarn to produce a multi-color pattern and which is characterized by essentially random and relatively short colorband lengths, and comprising the steps of dyeing all portions of a loosely gathered package of yarn with a base color, then penetrating the loosely gathered package at spaced apart locations with a plurality of elongate nozzles having a plurality of apertures along their length, and then injecting an atomized mixture of dye and gas from each of the apertured nozzles, with dyes of different colors being injected from different ones of the nozzles, whereby a random, multi-color dye pattern is produced on the yarn, and including separately supplying the dye and gas under substantially equal pressures to each of the nozzles at a point located immediately adjacent one end of each nozzle, to thereby assure that both the dye and gas will be injected from the nozzles and without an initial non-atomized squirt of dye being emitted therefrom.

2. The method as defined in claim 1 comprising the further step of drying the package subsequent to the base color dyeing step and prior to the injection step.

3. The method as defined in claim 2 comprising the further subsequent steps of subjecting the package to steam to set the dyes, removing moisture from the package, and finally winding the yarn into a more compact form.

4. A method for space dyeing yarn which is characterized by essentially random and relatively short colorband lengths, and comprising the steps of penetrating a loosely gathered package of yarn at spaced apart locations with a plurality of apertured nozzles, and then injecting an atomized spray of dye and a gas from each of the nozzles and such that the dye contacts a portion only of the yarn, and including separately supplying the dye and gas under substantially equal pressures to each of the nozzles at a point located immediately adjacent one end of each nozzle, to thereby assure that both the dye and gas will be injected from the nozzles and without an initial non-atomized squirt of dye being emitted therefrom.

5. The method as defined in claim 4 wherein the dye is injected concurrently from all of the nozzles.

6. The method as defined in claim 4 wherein the amount of sprayed dye is limited such that the yarn absorbs substantially all of the dye with substantially no running of liquid dye through the yarn package.

7. The method as defined in claim 6 wherein the package comprises a non-regularly wound skein of yarn.

8. The method as defined in either claim 1 or 4 wherein the package comprises a unitary length of yarn, to thereby facilitate the application of the dye in the interior of the package.

9. The method as defined in either claim 1 or 4 wherein the package is maintained loosely gathered and substantially non-compacted during the injecting step, to facilitate the penetration of the atomized spray into the package.

* * * * *